US011064778B2

(12) United States Patent
Tonelli

(10) Patent No.: US 11,064,778 B2
(45) Date of Patent: Jul. 20, 2021

(54) CARRYALL CONTAINER

(71) Applicant: G.T. LINE S.R.L., Frazione Crespellano (IT)

(72) Inventor: Massimo Tonelli, Bologna (IT)

(73) Assignee: G.T. LINE S.R.L., Frazione Crespellano (IT)

( * ) Notice: Subject to any disclaimer, the term of this patent is extended or adjusted under 35 U.S.C. 154(b) by 266 days.

(21) Appl. No.: 16/075,458

(22) PCT Filed: Feb. 3, 2017

(86) PCT No.: PCT/EP2017/052375
§ 371 (c)(1),
(2) Date: Aug. 3, 2018

(87) PCT Pub. No.: WO2017/134221
PCT Pub. Date: Aug. 10, 2017

(65) Prior Publication Data

US 2019/0037989 A1 Feb. 7, 2019

(30) Foreign Application Priority Data

Feb. 4, 2016 (IT) ..... 102016000011396

(51) Int. Cl.
*A45C 5/03* (2006.01)
*A47B 3/10* (2006.01)
(Continued)

(52) U.S. Cl.
CPC ..... *A45C 5/03* (2013.01); *A45C 5/04* (2013.01); *A45C 5/065* (2013.01); *A45C 9/00* (2013.01);
(Continued)

(58) Field of Classification Search
CPC .. A45C 5/03; A45C 5/04; A45C 5/065; A45C 9/00; A45C 13/02; A45C 2005/032;
(Continued)

(56) References Cited

U.S. PATENT DOCUMENTS 3,368,858 A 2/1968 Motter et al.
4,049,091 A 9/1977 Chubb
(Continued)

FOREIGN PATENT DOCUMENTS

CN 203228583 U 10/2013
CN 103707277 A 4/2014
(Continued)

OTHER PUBLICATIONS

International Search Report dated Mar. 13, 2017 re: Application No. PCT/EP2017/052375, pp. 1-3, citing: US 2008/240837 A1, U.S. Pat. No. 4,049,091 A, U.S. Pat. No. 3,368,858 A, WO 2015/087357 A1 and EP 1 975 502 A1.
(Continued)

*Primary Examiner* — Tri M Mai
(74) *Attorney, Agent, or Firm* — Cantor Colburn LLP

(57) ABSTRACT

A carryall container, includes at least one first half-shell, which is open and can be closed, at a free edge thereof, by a second half-shell, in order to define at least one closed configuration, in which inside the half-shells at least one internal compartment is defined for accommodating objects. The second half-shell is movable between the closed configuration and at least one open configuration, for free access to the compartment. One face of the first half-shell, which is adjacent to the free edge, has at least one door arranged, in at least one first position, so as to close a respective inlet provided on the first half-shell for further access to the compartment.

9 Claims, 9 Drawing Sheets

(51) Int. Cl.

| | |
|---|---|
| ***A45C 5/04*** | (2006.01) |
| ***A45C 5/06*** | (2006.01) |
| ***A45C 13/02*** | (2006.01) |
| ***B25H 3/02*** | (2006.01) |
| ***A45C 9/00*** | (2006.01) |
| ***A47B 61/06*** | (2006.01) |

(52) U.S. Cl.
CPC ..... *A45C 13/02* (2013.01); *A47B 3/10* (2013.01); *A47B 61/06* (2013.01); *B25H 3/027* (2013.01); *B25H 3/028* (2013.01); *A45C 2005/032* (2013.01); *A45C 2005/037* (2013.01); *A45C 2013/026* (2013.01)

(58) Field of Classification Search
CPC ..... A45C 2005/037; A45C 2013/026; A47B 3/10; A47B 61/06; B25H 3/027; B25H 3/028
See application file for complete search history.

(56) References Cited

U.S. PATENT DOCUMENTS

| | | | | |
|---|---|---|---|---|
| 4,570,887 | A * | 2/1986 | Banister | F16M 11/041 248/187.1 |
| 5,281,019 | A * | 1/1994 | Rodeck | A47B 97/02 190/11 |
| 6,543,436 | B2 * | 4/2003 | Montgomery | F24C 3/14 126/305 |
| 8,075,208 | B2 * | 12/2011 | Green | A47B 21/00 400/94 |
| 8,333,271 | B2 * | 12/2012 | Gibson | A45C 9/00 190/18 R |
| 8,752,912 | B1 * | 6/2014 | Johns | A47B 13/023 312/241 |
| 2007/0131825 | A1 * | 6/2007 | Skrodzki | F16M 11/2014 248/177.1 |
| 2008/0240837 | A1 | 10/2008 | Green | |

FOREIGN PATENT DOCUMENTS

| | | | |
|---|---|---|---|
| EP | 1975502 | A1 | 10/2008 |
| WO | 2015087357 | A1 | 6/2015 |

OTHER PUBLICATIONS

Written Opinion dated Mar. 13, 2017 re: Application No. PCT/EP2017/052375, pp. 1-3, citing: US 2008/240837 A1, U.S. Pat. No. 4,049,091 A, U.S. Pat. No. 3,368,858 A and WO 2015/087357 A1.

* cited by examiner

CARRYALL CONTAINER

TECHNICAL FIELD

The present disclosure relates to a carryall container.

BACKGROUND

As is known, on the market it is possible to find various solutions that enable a user to transport objects of various types, such as for example items of clothing, professional tools and equipment, personal computers and other electronic devices etc.

According to implementation solutions that are now consolidated, many conventional solutions are constituted by suitcases, trolley cases or trunks, all made up of two half-shells which are mutually articulated, so as to define, in a closed configuration, an internal compartment designed to accommodate the objects to be transported.

In more detail, professional users especially particularly appreciate containers that make it possible to accommodate a large number of objects in an ordered manner, and which to this end make use of internal pockets, dividing walls, laces and/or other retention elements. Such accessories in fact enable the user to immediately retrieve the instruments that he/she has chosen to bring with him/her, when he/she needs to use them, thus facilitating the work activity.

Another need that is increasingly often felt by professional (and other) customers is that of being able to rely on a container that can ensure high resistance to shock, and impenetrability to water, dust, sand and in general other impurities present in the environment.

In fact, in several sectors of application the need is felt to transport and/or use tools and equipment that are delicate (of the medical, photographic, military, electronic type etc.) in unfavorable environmental conditions (in a desert, at sea, in a jungle etc.), which in any case are such as to present no small risk for the integrity of the material accommodated in the container.

Trunks or suitcases that are capable of bringing together the two requirements described above are therefore increasingly in demand, and therefore in recent years an increase has been seen in the solutions that meet such needs in various different ways.

Among other solutions, some large-sized trunks are now available on the market which have different methods of accessing the internal compartment, which in turn is divided into several separate chambers.

In such trunks in fact, not only is it possible to rotate a first half-shell (the lid) with respect to the other (the base), but also there is a door, provided on the front face of the base, which is also capable of providing access to the compartment, for the purpose of offering a more practical use of the internal spaces.

In addition, such trunks are made with rigid materials (for the desired resistance to shock) and, by virtue of a suitable choice of implementation solution of the couplings between the various parts that compose them, they are capable of ensuring a total hermetic seal, thus guarding against the intrusion of water, dust, sand or other impurities.

Such implementation solutions are not devoid of drawbacks, however.

In fact, such implementation solutions are frequently adopted by professionals who have even more complex requirements, for whom it is no longer sufficient to have neatly-ordered tools and equipment to hand, in a rigid container that can be transported at will to vastly disparate locations.

Since they often have to work in places that completely lack not only the necessary tools, but also adequate infrastructure, the mere ordered accommodation of tools or objects in general, offered by conventional containers, is now inadequate to meet requirements, since practical conditions for working are still lacking.

The aim of the present disclosure is to solve the above mentioned problems, by providing a highly resistant carryall container, which can offer direct support to professionals and users in general, during their work.

SUMMARY

Within this aim, the disclosure provides a carryall container that can be converted as needed to a form of work station, while ensuring practical means of transporting all the instruments and objects that are necessary for the user's work.

The disclosure also provides a carryall container that can be converted as needed to a form of work station, while still retaining several possibilities for the ordered partitioning of tools, equipment and objects in general.

The disclosure further provides a carryall container that shows itself to be an effective support in professional activity, offering the user what he/she needs to work, even in vastly disparate locations.

The disclosure also provides a carryall container that ensures a high reliability of operation and which is resistant to shock and impenetrable to water, dust, sand and impurities in general.

The disclosure further provides a carryall container that adopts an alternative technical and structural architecture to those of conventional containers.

The disclosure provides a carryall container that can be easily implemented using elements and materials that are readily available on the market.

The disclosure also provides a carryall container that is low cost and safely applied.

These advantages which will become better apparent hereinafter are achieved by providing a carryall container, comprising at least one first half-shell, which is open and can be closed, at a free edge thereof, by a second half-shell, in order to define at least one closed configuration, in which inside said half-shells at least one internal compartment is defined for accommodating objects, said second half-shell being movable between said closed configuration and at least one open configuration, for free access to said compartment, one face of said first half-shell, which is adjacent to said free edge, having at least one door arranged, in at least one first position, so as to close a respective inlet provided on said first half-shell for further access to said compartment, said door being selectively movable between said first position and at least one second position, for free access to said compartment through said inlet, characterized in that it comprises an auxiliary element for stably resting on the ground, which can be associated detachably with the base of said first half-shell, on the opposite side with respect to said free edge, said element comprising a fixed supporting structure for a plurality of legs, which can move between a minimum space occupation arrangement, in which they can be arranged so as to face and be proximate to said structure and said element can be accommodated in said compartment, and an active arrangement, in which they are extended from said structure in order to define, when said element is associated with said base, a stable resting on the ground.

BRIEF DESCRIPTION OF THE DRAWINGS

Further characteristics and advantages of the disclosure will become better apparent from the detailed description that follows of a preferred, but not exclusive, embodiment of the carryall container according to the disclosure, which is illustrated by way of non-limiting example in the accompanying drawings, wherein.

DETAILED DESCRIPTION OF THE DRAWINGS

Figure 1:
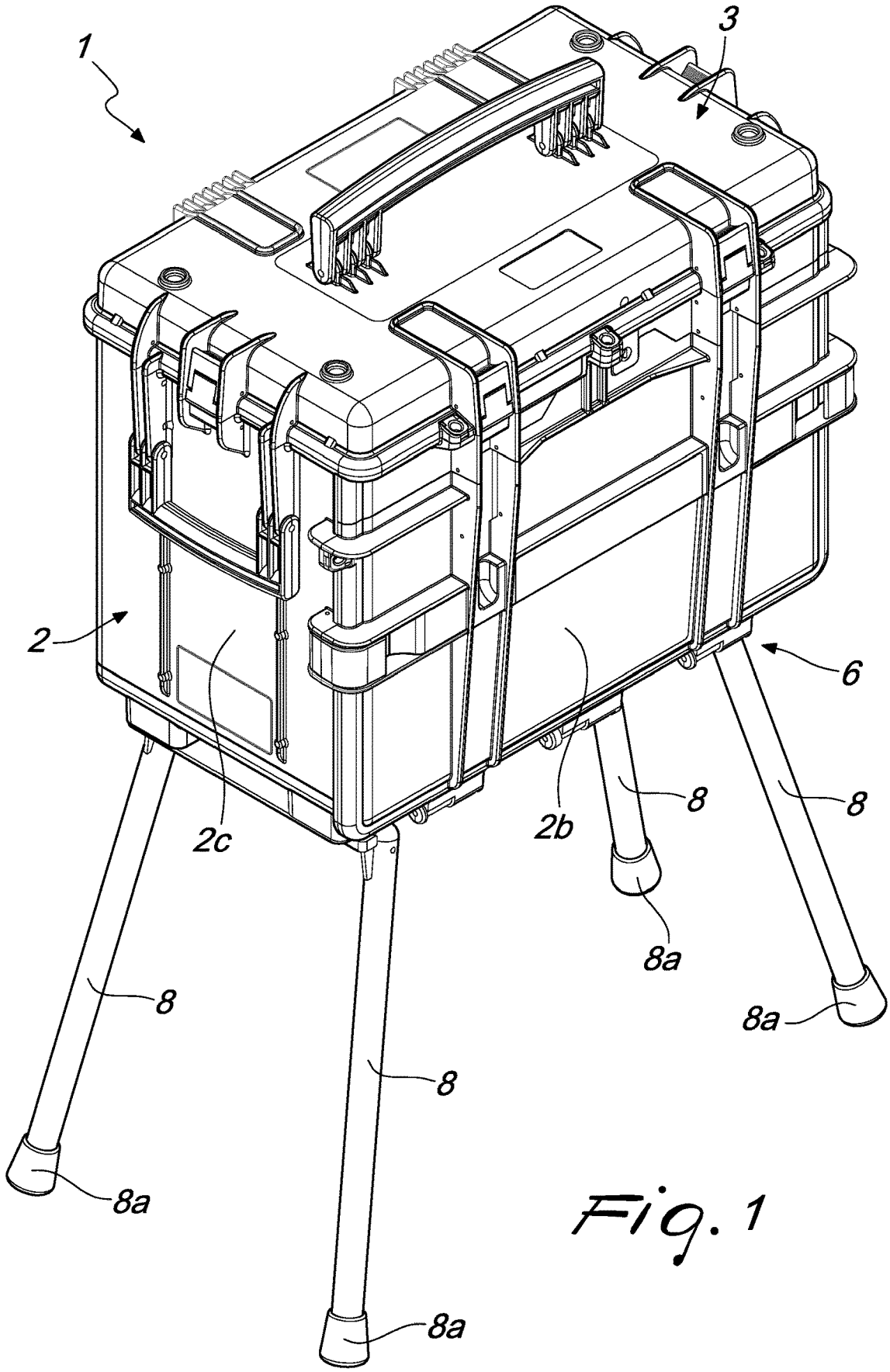
FIG. 1 is a perspective view from above of the carryall container, with the second half-shell in the closed configuration, the door in the first position and the legs in the active arrangement.

With reference to FIGS. 1-13, the reference numeral 1 generally designates a carryall container, of the type of trunks, suitcases, trolley cases, and the like.

It should be noted from this point onward that the scope of protection claimed herein covers containers 1 of any type, shape and size, and made with any materials, for both private and professional use.

In the preferred application, which is cited for the purposes of non-limiting explanation of the application of the disclosure, the container 1 is in any case a rigid trunk, made of a material (typically but not exclusively polymeric) with a high resistance to shock and provided with seals and gaskets that are adapted to ensure its complete hermetic seal, and intended to transport, for professional use, equipment, tools and instruments.

In any case, the container 1 comprises at least one first half-shell 2, which is open and which, at a free edge 2*a* thereof, can be closed by a second half-shell 3. In this manner, the second half-shell 3 defines a closed configuration (shown for example in FIGS. 1, 7 and 8) in which, inside the half-shells 2, 3 (which are typically, but not exclusively, coupled rotatably), at least one internal compartment 4 is defined in which objects can be accommodated.

Figure 2:
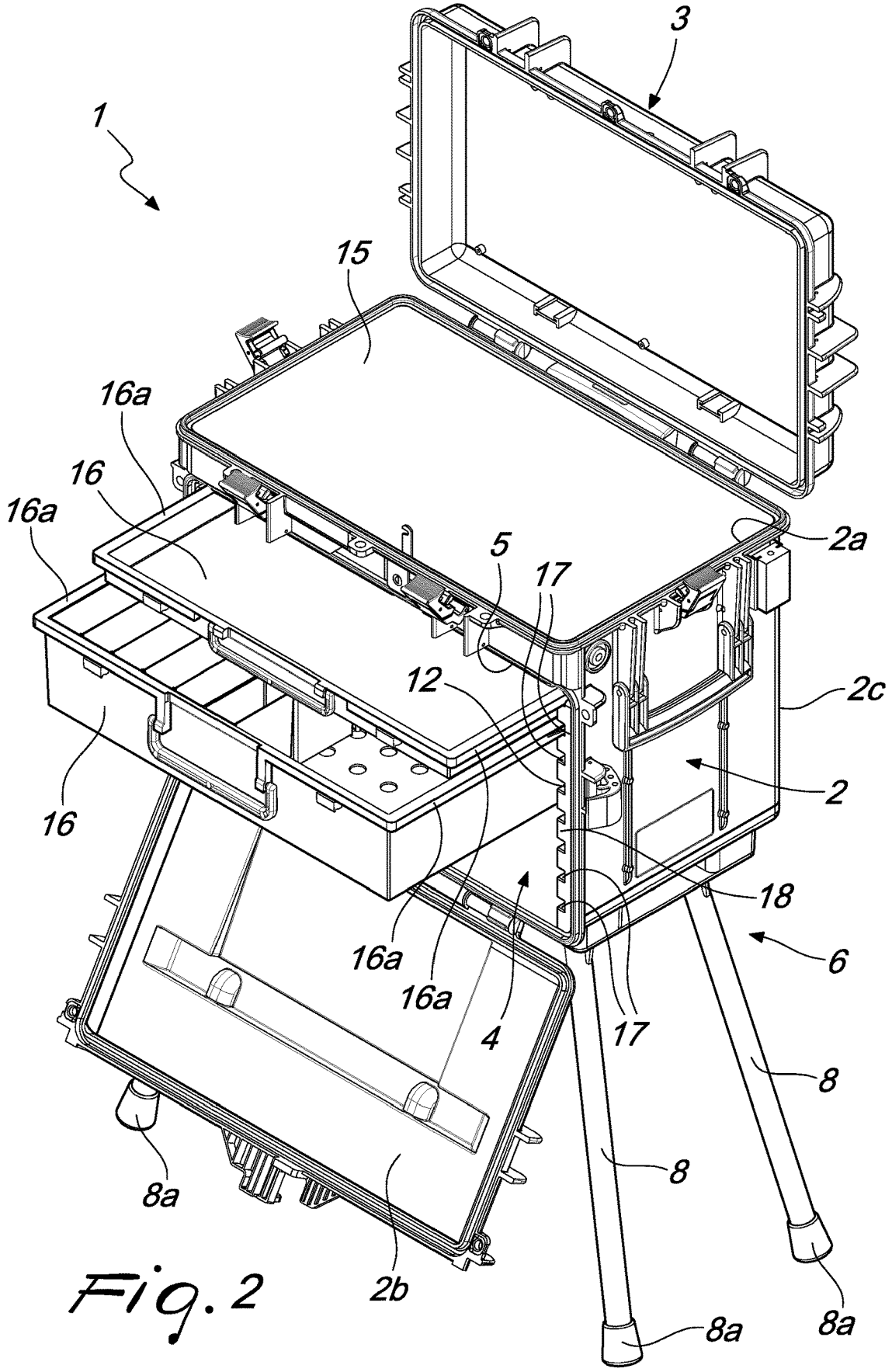
FIG. 2 is a perspective view from above of the carryall container of FIG. 1, with the second half-shell in the open configuration, the door in the second position and the legs in the active arrangement.
Figure 3:
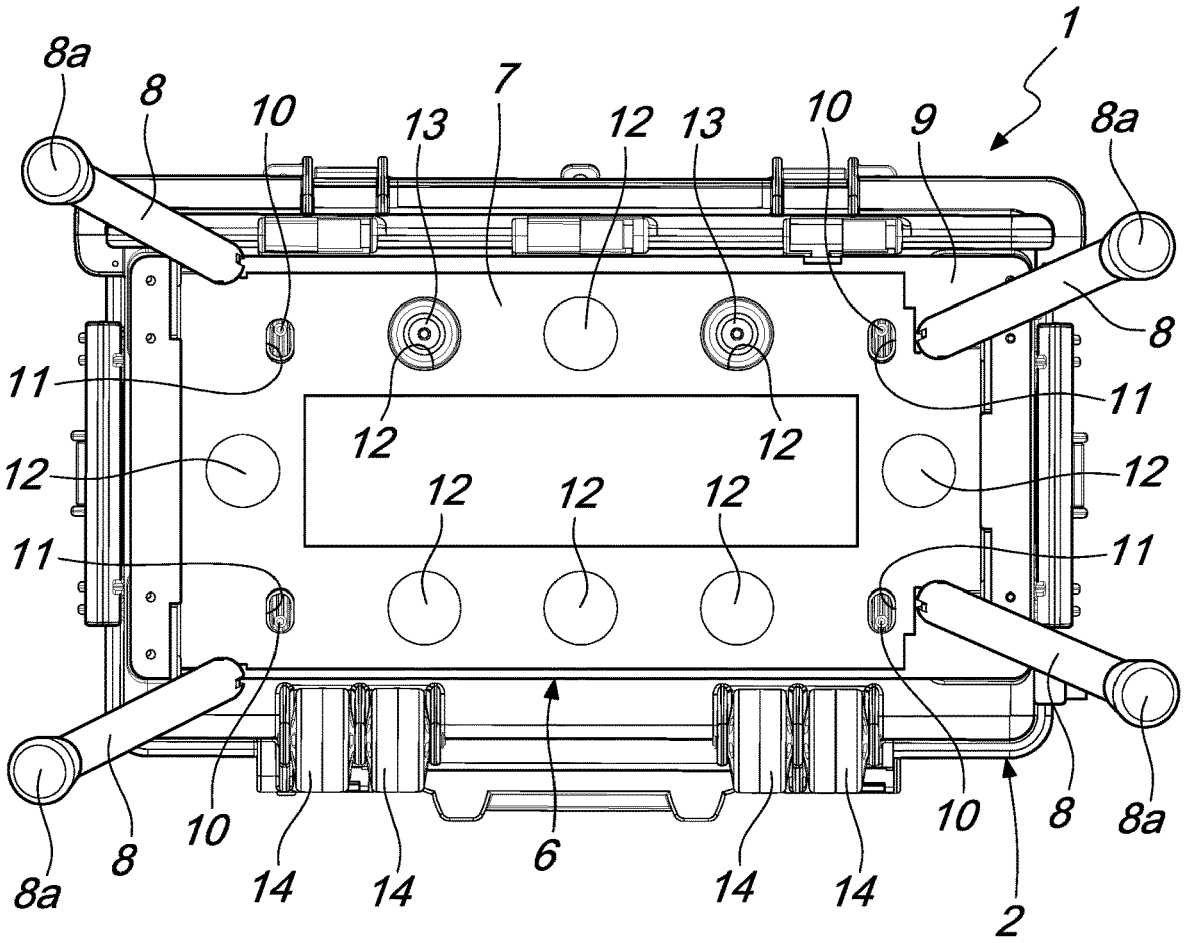
FIGS. 3 and 4 are views from below of the carryall container of FIG. 1, and show some elements that implement a possible method of coupling between the auxiliary element and the first half-shell.
Figure 5:
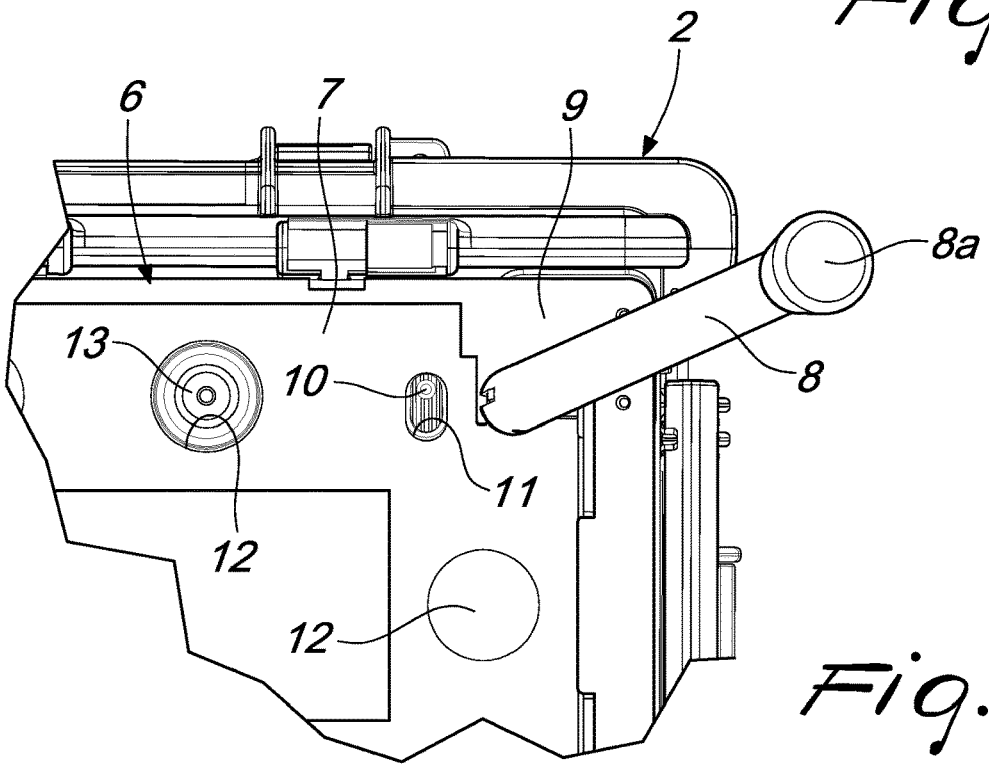
FIGS. 5 and 6 are greatly enlarged details of FIGS. 3 and 4.
Figure 4:
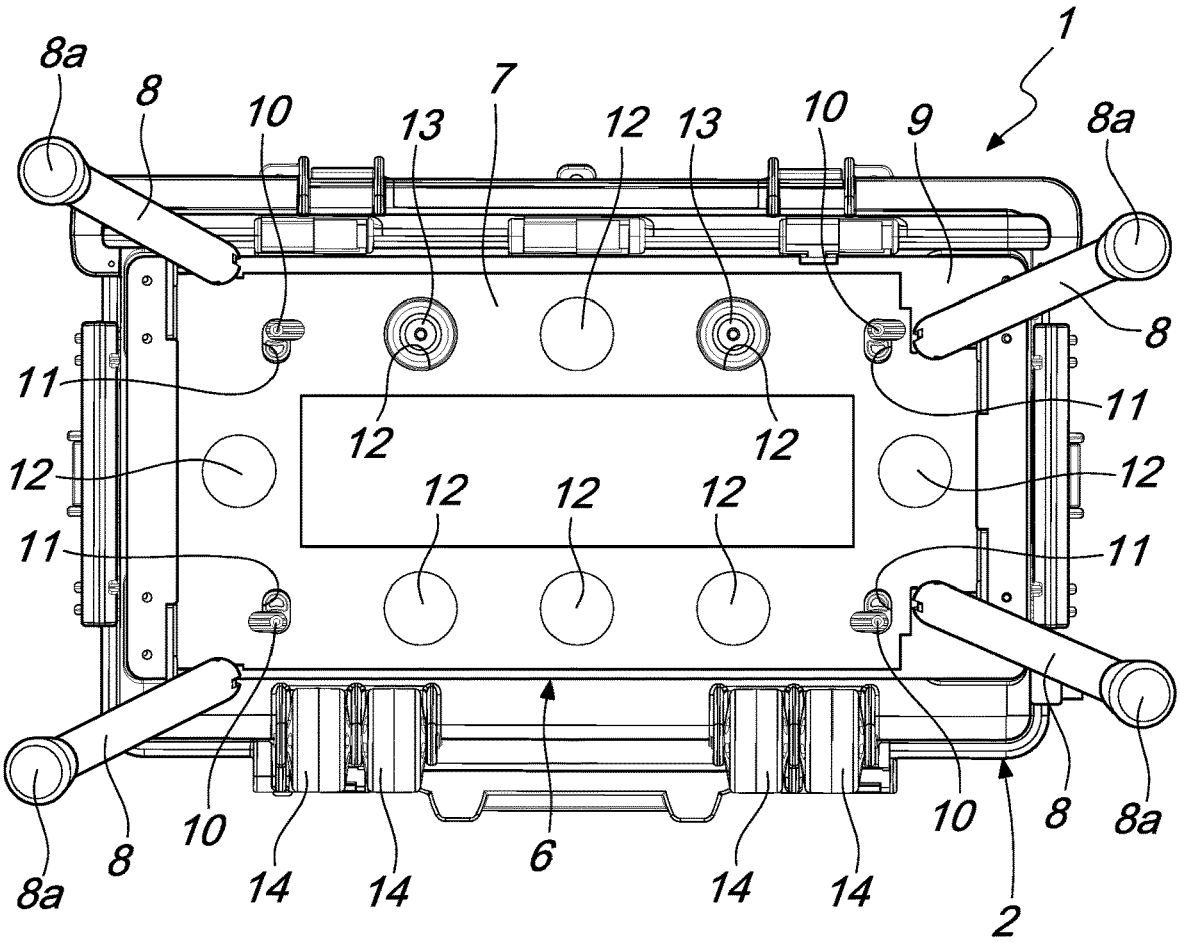
Figure 6:
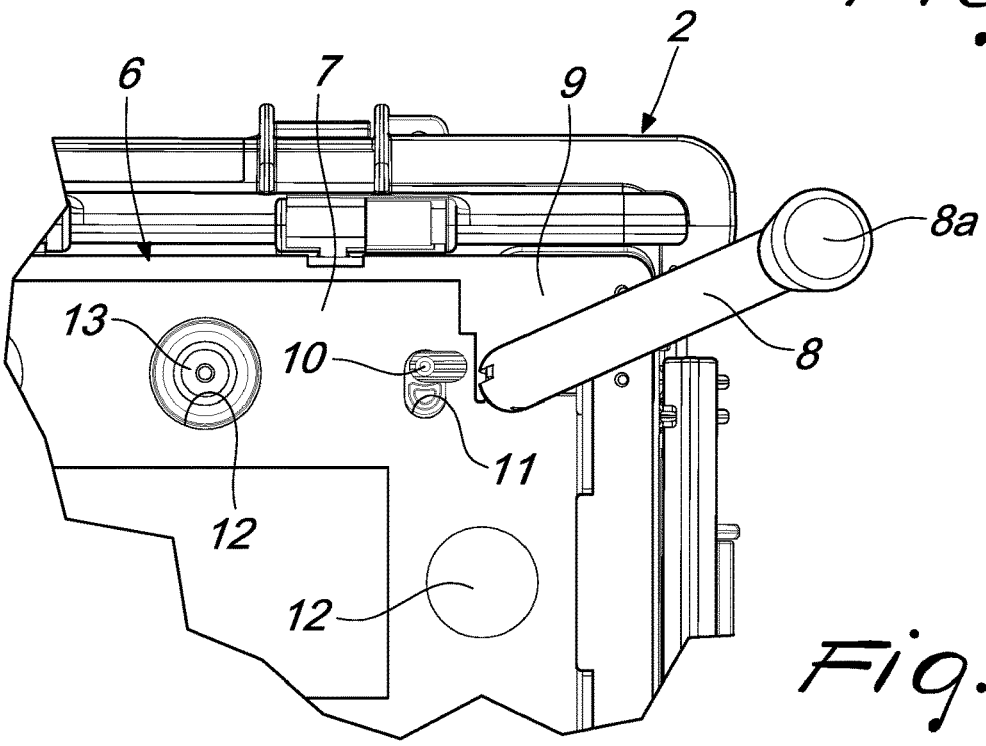
Figure 7:
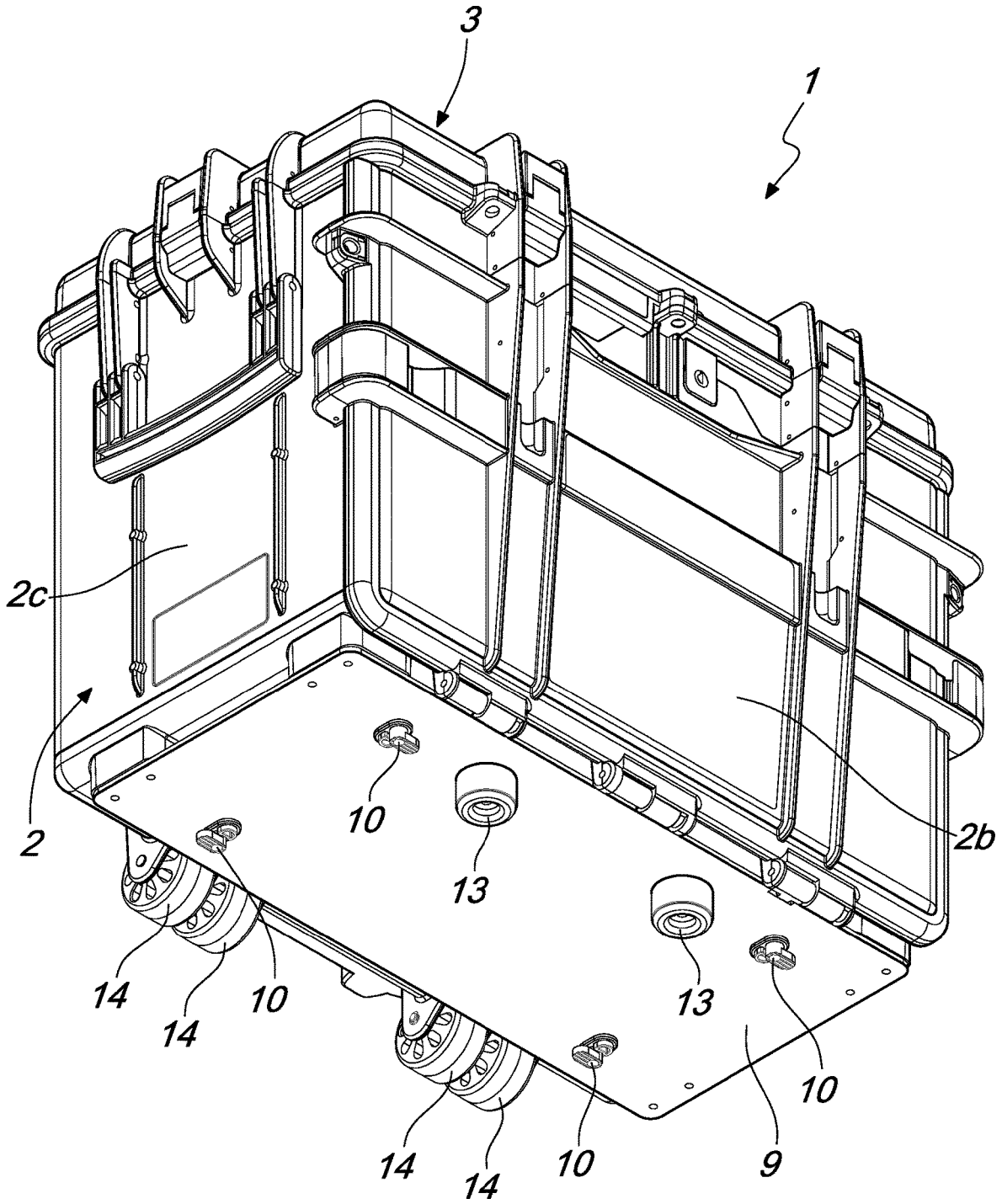
FIGS. 7 and 8 are perspective views from below of the two half-shells of the container of FIG. 1, and show the elements of FIGS. 3 and 4.
Figure 8:
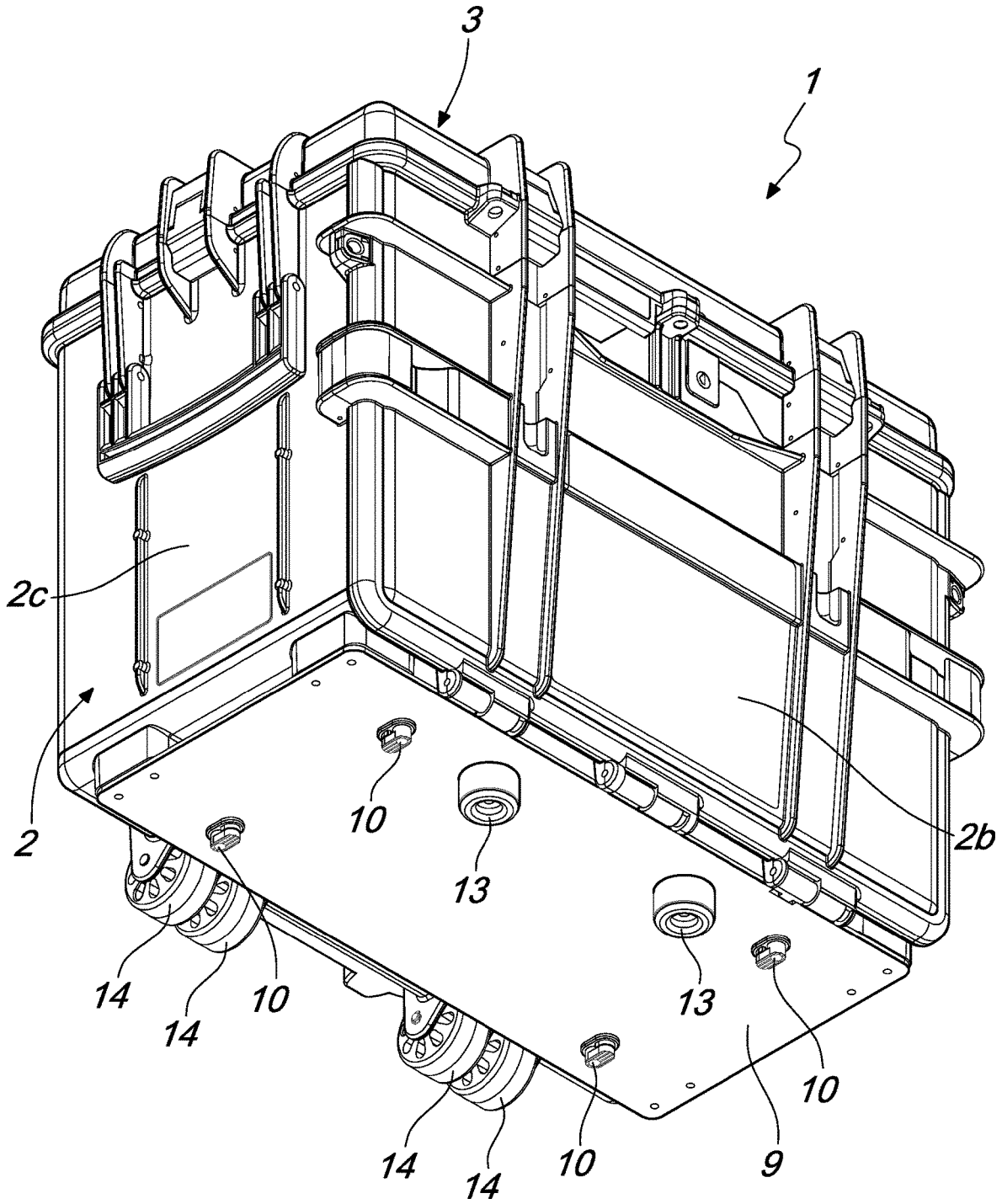
Figure 9:
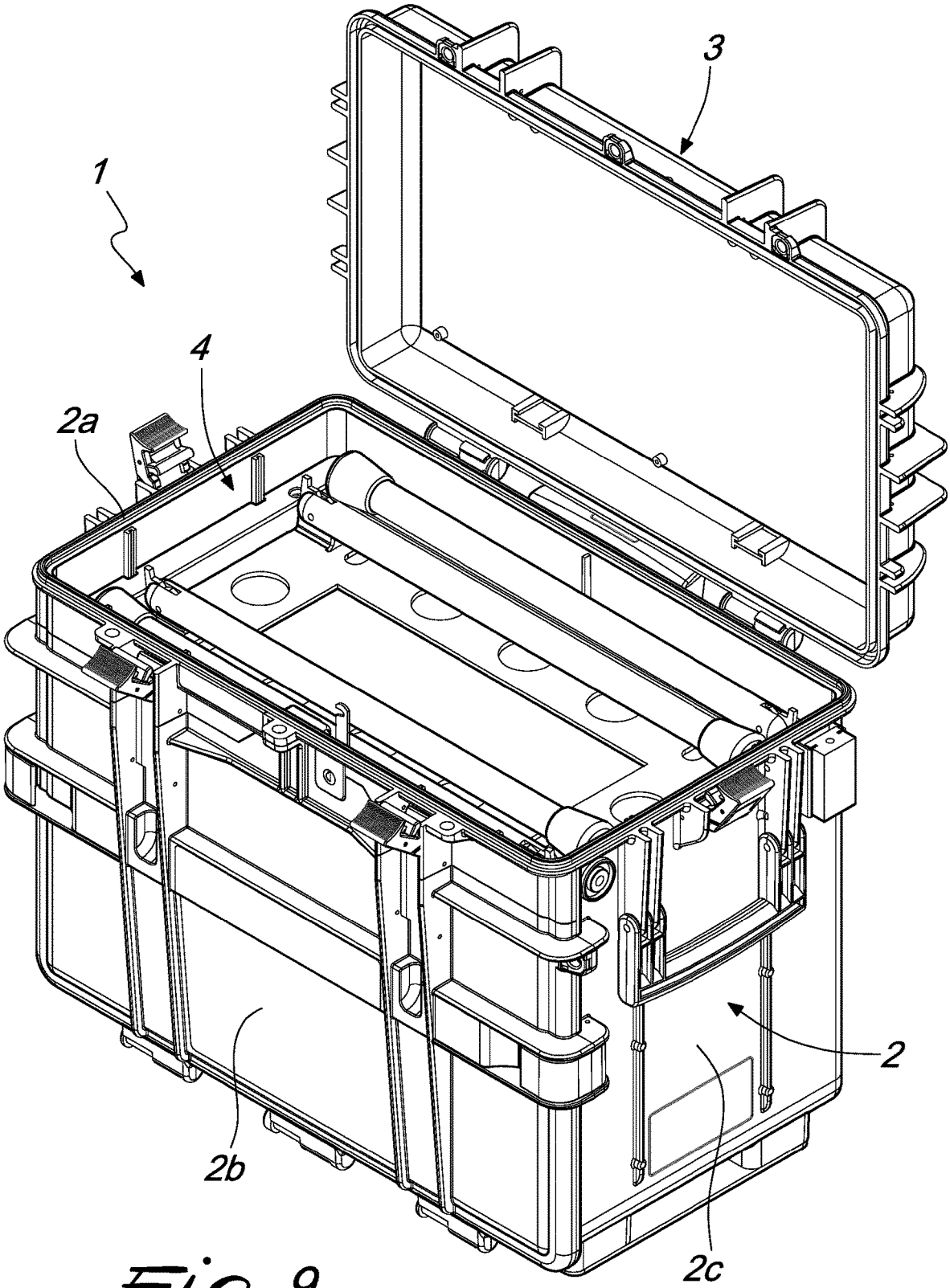
FIG. 9 is a perspective view from above of the carryall container of FIG. 1, with the second half-shell in the open configuration, the door in the first position and the legs in the minimum space occupation arrangement, accommodated in the compartment.

The second half-shell 3 is therefore movable between the closed configuration and at least one open configuration, in which it allows free access to the compartment 4 (FIGS. 2 and 9).

The objects accommodated or accommodatable in the compartment 4 (and optionally in an ordered manner, as will be seen), can be any, and evidently depend on the needs of the user and on the use that he/she wishes to make of the container 1 proper.

For example therefore, the container 1 can accommodate in its compartment 4 professional equipment and tools, which can thus be easily carried to the place of work or intervention, where they can then in each instance be taken out and used.

Precisely in order to allow further and practical methods of access to the compartment 4, one face of the first half-shell 2, adjacent to the free edge 2*a*, is provided with at least one door 2*b*.

The door 2*b* is therefore arranged, in at least one first position (FIGS. 1, 7, 8 and 9), so as to close a respective inlet 5, provided on the first half-shell 2, for further access to the compartment 4.

Furthermore, the door is selectively movable between the first position and at least one second position (FIG. 2), in which it allows free access to the compartment 4, through the inlet 5, and therefore even when the second half-shell 3 is arranged in the closed configuration.

The accompanying figures show an embodiment in which the aforementioned face is the front face: it should be noted however that the protection also covers different implementation choices, for the placement of the door 2*b* along the first half-shell 2.

The presence of the door 2*b* offers direct access to a different area of the compartment 4 (and furthermore, even when the latter is closed on top by the second half-shell 3), thus favoring easier retrieval (and withdrawal) of instruments, tools, equipment, and objects in general, which are accommodated in the compartment 4. Such practicality of retrieval is further increased through the use of pockets, dividers, retention elements, or further accessories, which will be illustrated later in the present discussion.

It should be noted that the term compartment 4 is used here to mean the entire region of space delimited overall by the two half-shells 2, 3 (in the closed configuration obviously), which is accessible as has been seen both through the mouth delimited by the edge 2*a*, and through the inlet 5.

As will be seen, according to various methods and/or with different accessories the compartment 4 can further be divided into further sub-spaces, which can be configured variously as a function of the needs of each user.

According to the disclosure, the container 1 comprises an auxiliary element 6 for stably resting on the ground, which can be associated detachably (coupled directly or indirectly, as will be seen) with the base of the first half-shell 2, on the opposite side with respect to the free edge 2*a*.

Figure 10:
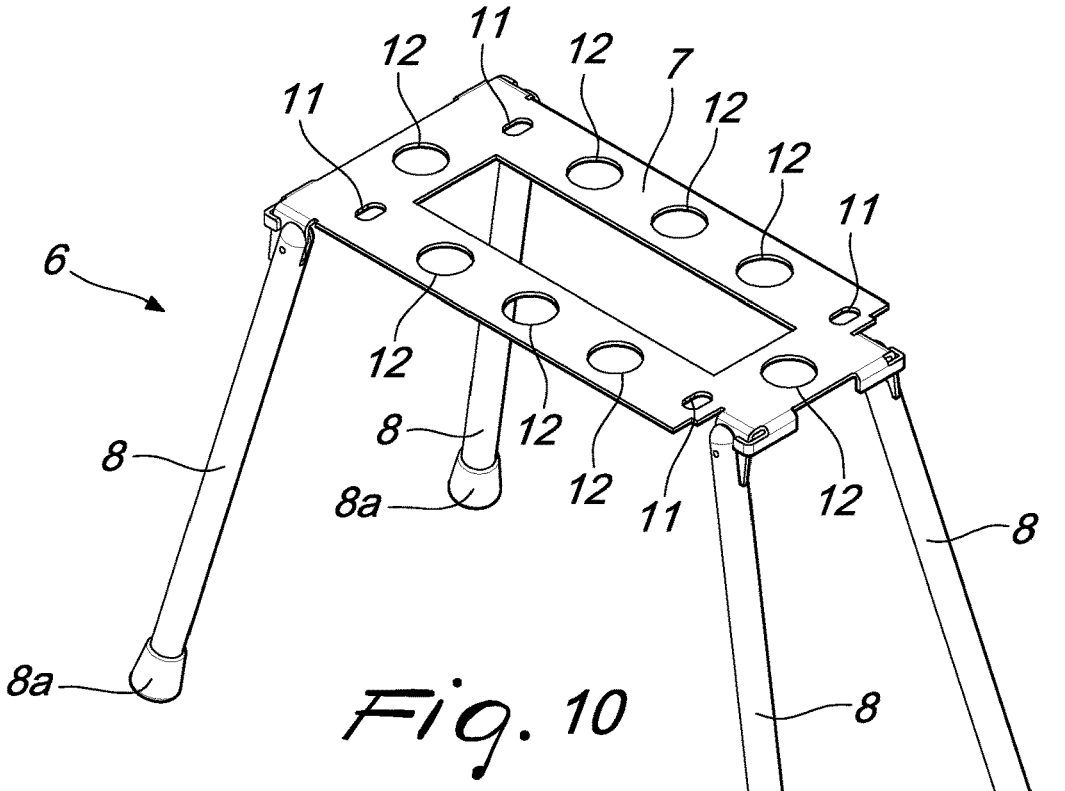
FIG. 10 is a perspective view from above of the auxiliary element, with the legs in the active arrangement.
Figure 11:
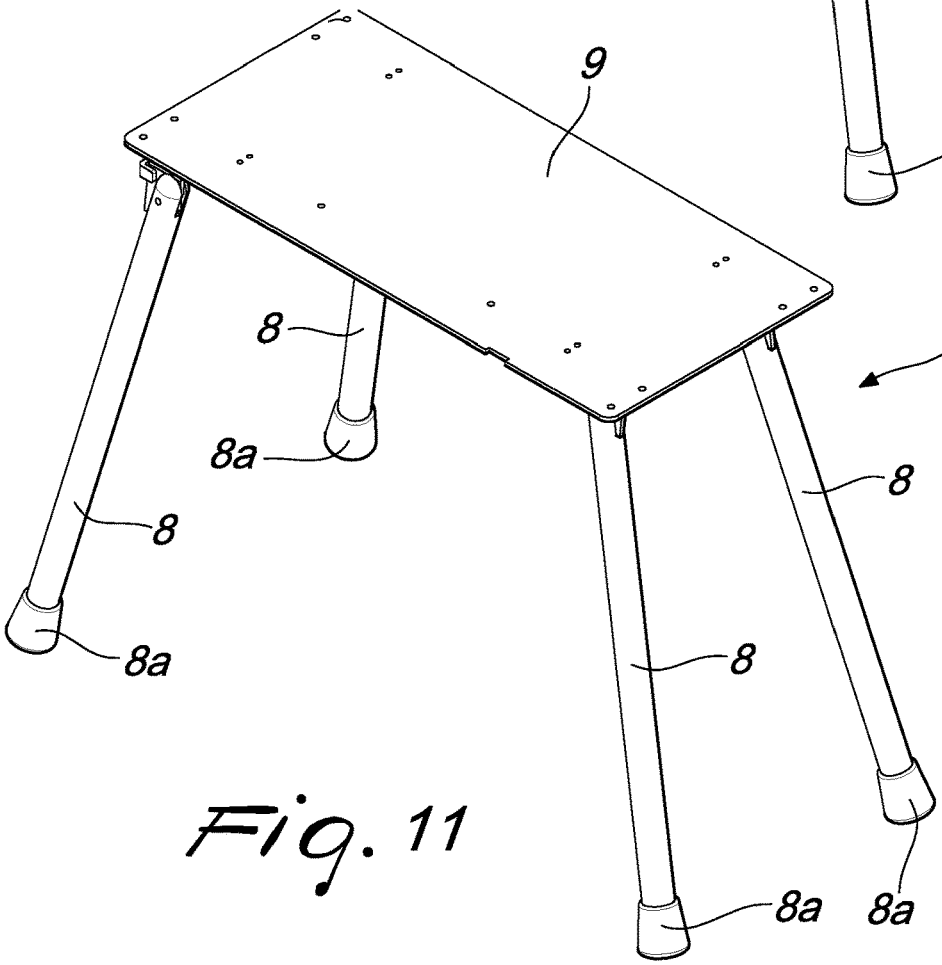
FIG. 11 is a perspective view from above of the auxiliary element and a further element, with the legs in the active arrangement.

As can be clearly seen (for example) in FIG. 10, the element 6 comprises a fixed structure 7 for supporting a plurality of legs 8.

The legs 8 can be moved between a minimum space occupation arrangement and an active arrangement. In the minimum space occupation arrangement, the legs 8 can be arranged so as to face and be proximate to the structure 7 and the element 6 can be accommodated in the compartment 4 (FIG. 9). Conversely, in the active arrangement the legs 8 are extended from the structure 7 and define, obviously when the element 6 is associated with the base of the first half-shell 2, a stable resting on the ground.

It should be noted therefore that the element 6 makes it possible to arrange the half-shells 2, 3 at a raised vertical height, while at the same time ensuring the stability on the ground. The container 1 according to the disclosure can offer direct support for professionals and users in general, during their work. In more detail, as will be better explained below, in relation to some application examples, this allows new and interesting modes of direct interaction with the container 1 proper (in addition to making it easier and more practical to retrieve tools accommodated inside it).

Likewise, when the container 1 is transported to the place of work, the element 6 can be comfortably accommodated in the compartment 4, and is also transported without causing the user hindrance.

In an embodiment of significant practical interest, shown in the accompanying figures for the purposes of non-limiting example of the application of the disclosure, each leg 8 comprises a rigid rod, articulated with one of its ends to the structure 7, in order to allow the movement thereof between the minimum space occupation arrangement and the active arrangement.

Furthermore, each rod has dimensions (and in particular, obviously, the length) that are compatible with its being accommodated in the compartment 4, in the minimum space occupation arrangement.

With further reference to the solution shown in the accompanying figures, it should be noted in fact that each leg 8 is substantially resting on the structure 7, in the minimum bulk configuration, while it is conveniently rotated in the active arrangement, so as to be arrangeable inclined to support the half-shells 2, 3, in the active arrangement.

In order to be capable of being accommodated in the compartment 4, the length of each leg 8 is therefore chosen to be less than the largest dimension (or at least less than the diagonal) of the rectangular cross-section of the half-shells 2, 3.

The possibility is not ruled out however of adopting different solutions, in order to achieve the accommodation in the compartment 4: for example, the legs 8 can be telescopic (and therefore, in the active arrangement, longer than the previous case), or they can be associated with the structure 7 detachably, allowing the substantial disassembly of the element 6 when the user wants to place it in the container 1.

In order to increase the stability of support, each leg 8 can have, on the opposite side from the structure 7, an enlarged flared head 8*a*.

It should be noted that the element 6 can be coupled directly to the base of the first half-shell 2, i.e. without the interposition of further components.

Conversely, in the preferred embodiment, shown for the purposes of non-limiting example in the accompanying figures, the container 1 comprises a plate 9 that can be applied externally to the base of the first half-shell 2 in a stable manner.

The plate 9 performs a twofold function: firstly in fact, it defines a resting support on the ground, at least when the element 6, in the minimum space occupation arrangement, is accommodated in the compartment 4 (or in any case it is not associated with the base).

Furthermore, the plate 9 is detachably associatable with the structure 7 by way of respective selective fixing means and it is by way of this that the indirect coupling is achieved between the element 6 and the base of the first half-shell 2.

In this regard, it should be noted that the container 1 can be supplied with the plate 9 already fixed (by way of nails, rivets, bolts, or the like) to the base of the first half-shell 2, or it can be supplied with the plate 9 disassembled, leaving it to the user to choose when to anchor it to the base.

More specifically, the selective fixing means comprise a plurality of teeth 10 (FIGS. 3, 4, 5, 6, 7, 8) that protrude from the plate 9 and which can rotate between at least one first angular orientation and at least one second angular orientation.

When they are arranged in the first angular orientation (FIGS. 3, 5 and 7), the teeth 10 can be freely inserted into respective slots 11 provided on a contoured plate, which substantially defines the structure 7. Obviously, as long as the teeth 10 maintain the first angular orientation, the free extraction from the slots 11 is likewise possible.

Conversely, in the second orientation (FIGS. 4, 6 and 8), the teeth 10, after they have been inserted into the slots 11, and are now rotated for example through 90°, oppose by mechanical interference the subsequent extraction of the plate 9, thus rapidly and easily determining the fixing of the element 6 to the plate 9, and therefore to the first half-shell 2.

Conveniently, the plate has a plurality of centering holes 12, into each one of which a respective complementarily shaped resting foot 13 can be inserted, which extends from the plate 9.

It has already been seen that, right at the plate 9, the container 1 is arranged in contact with the ground, when the element 6 is not used for such purpose: in such context, the feet 13 evidently offer a more practical support.

Likewise, when it is desired to use the element 6, the feet 13 can be inserted into the centering holes 12, which enable the optimal alignment between the plate 9 and the structure 7 and therefore facilitate the insertion of each tooth 10 into the respective slot 11.

It should be noted that along the plate that defines the structure 7 there can be more holes 12 than feet 13 (as in the example in the accompanying figures); this makes it possible to use the same element 6 even when the user wishes to change the configuration of the plate 9 and/or the arrangement of the feet 13, according to the specific requirements.

Furthermore, when the element 6 is not used, it should be noted that the container 1 can rest on the ground only at an adequate number of feet 13 (four for example), or, as in the accompanying figures, an optionally smaller number of feet 13 (two for example) can to this end cooperate with wheels 14, which likewise enable a convenient mode of pulling the container 1, which is thus moved as usually occurs for trolley cases.

Conveniently, the container 1 comprises a worktop 15, which can be transported inside the compartment 4 and can be arranged along the free edge 2*a* of the first half-shell 2, so as to close the compartment 4 proper (as in FIG. 2), at least when the second half-shell 3 is arranged in the open configuration.

More precisely, the worktop 15 can be transported in such arrangement even when the second half-shell 3 is arranged in the closed configuration, in some embodiments, while in others it can be easily removed from the edge 2*a* and otherwise placed in the compartment 4, when the user wishes to bring the second half-shell 3 to the closed configuration.

As is clear from FIG. 2, when the worktop 15 is arranged on the edge 2*a* of the first half-shell 2, it defines a practical work surface, on which therefore the user can effectively carry out his/her activities (counting on the stable and raised configuration ensured by the element 6).

Advantageously, in order to define an additional and practical mode of use of the container 1 according to the disclosure (of some of its components/accessories), the latter can comprise selective anchoring means, adapted to provide the stable and detachable coupling between the worktop 15 and the element 6, at least when the legs 8 are in the active arrangement.

Figure 12:
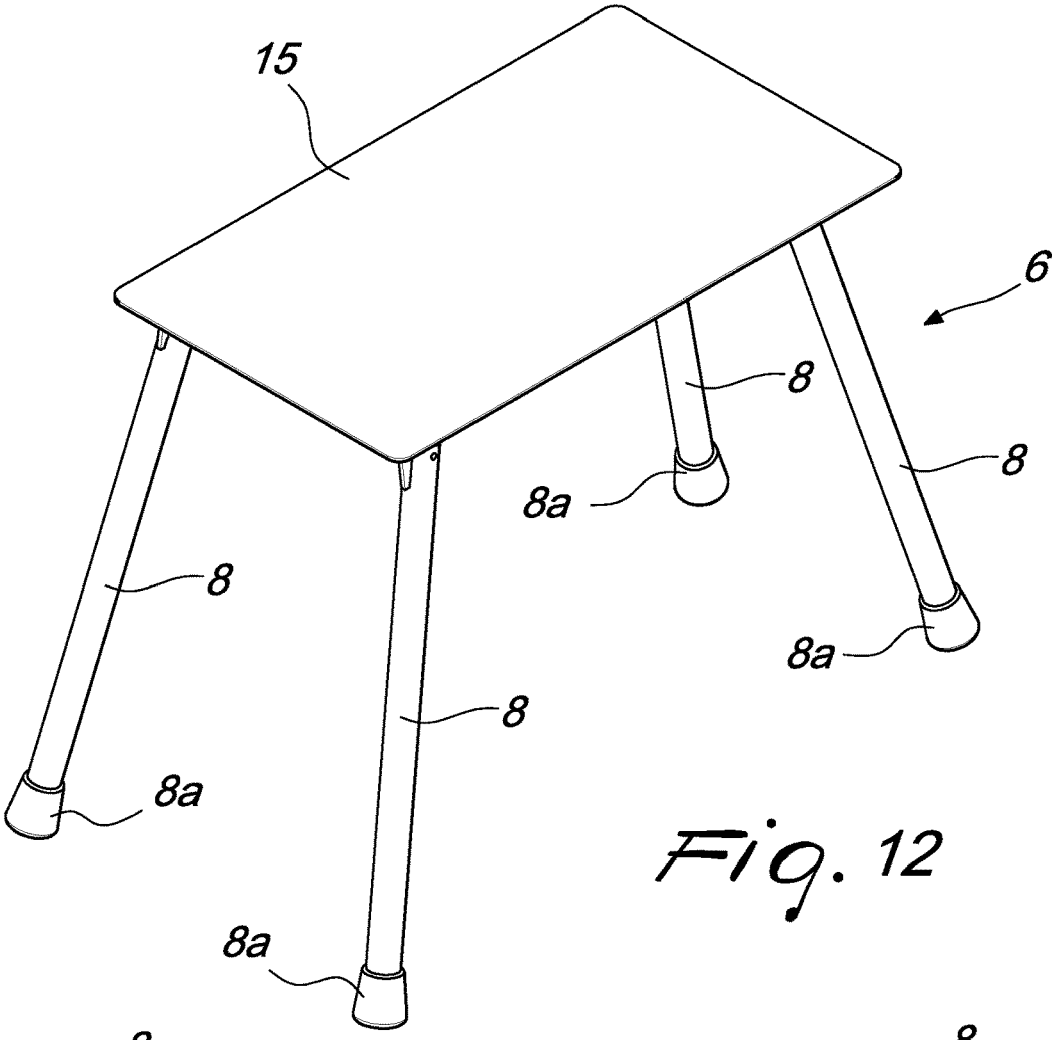
FIG. 12 is a perspective view from above of another mode of use of the container and in particular of the auxiliary element.

So in fact, and as can be seen in FIG. 12, in an additional mode of use of the container 1 the worktop 15, extracted completely from the container 1, is coupled to the element 6, so as to define a kind of independent table, available to the user (and in turn transportable).

While not ruling out the possibility that the coupling between the worktop 15 and the element 6 can be provided in another manner, in order to reduce the number of components and increase the practicality of use of the disclosure preferably the selective anchoring means mentioned previously are entirely similar to the selective fixing means already described, and are responsible for the coupling between the plate 9 and the element 6.

Figure 13:
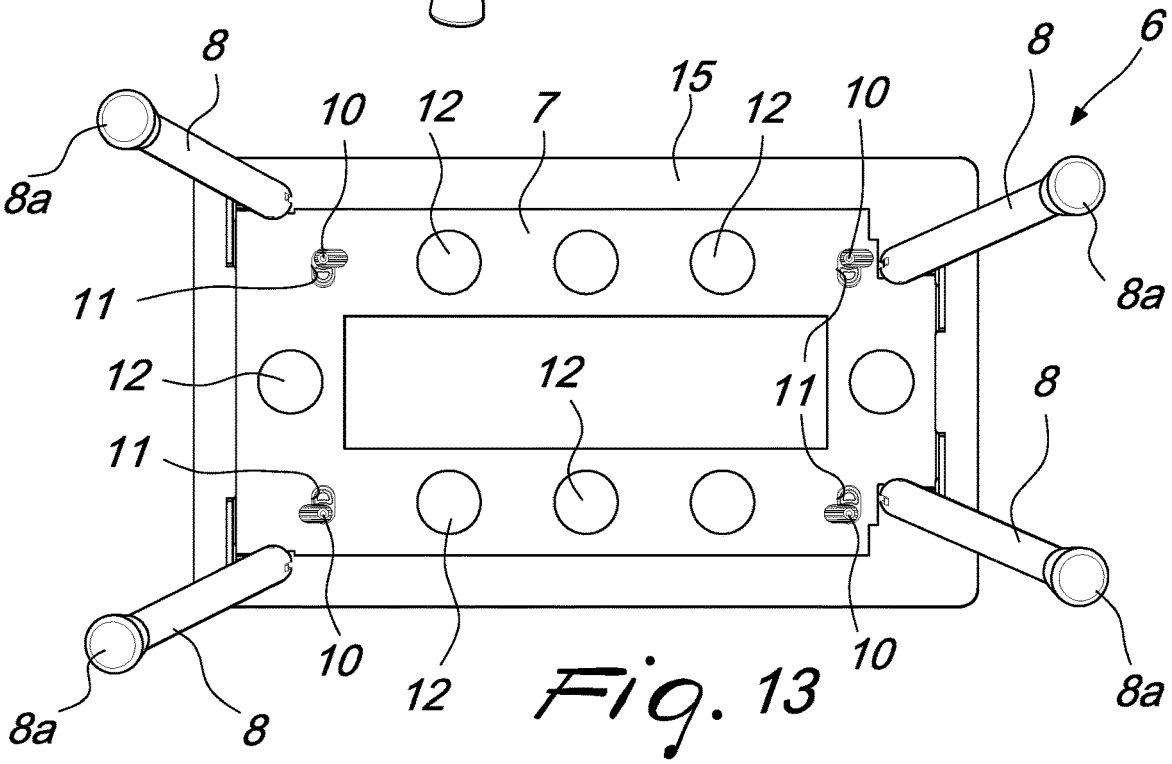
FIG. 13 is a view from below of the elements of FIG. 12.

As can be seen in fact from FIGS. 12 and 13, the worktop 15 can be provided with further teeth 10 which protrude and are free to rotate, so as to be in turn insertable into the slots 11 of the structure 7 and subsequently prevent the extraction by interference fit.

In order to increase the practicality of use of the container 1, and ensure optimal working conditions for the user, when the user wants to work in the immediate vicinity of the container 1 (and/or on the worktop 15), the container 1 proper comprises a light source (a lamp for example, optionally provided with a respective battery, so that it can be used even in the absence of other sources of electricity).

The light source can be conveniently transported inside the compartment 4 and be extracted from it at will, in order to be detachably anchored to one of the half-shells 2, 3 (by way of adapted retention elements), in order to illuminate the surrounding area.

The lamp, or other light source, is preferably supported by a telescopic post, which can in turn be accommodated in the container 1 and which, when the user wishes to use the lamp, enables the placement thereof at a raised vertical height, sufficient to adequately illuminate the surrounding area and the worktop 15 (arranged on the edge 2*a*).

Advantageously, in order to enable an optimal partitioning of the spaces inside the compartment 4, while facilitating an immediate retrieval thereof, the container 1 comprises means for guiding the sliding of at least one drawer 16, which can be accommodated completely in the compartment 4 and can be extracted at least partially from it (FIG. 2) at at least one between the open configuration of the second half-shell 3 and the second position of the door 2*b*.

It should be noted that in the embodiment shown in the accompanying figures, the drawer 16 can slide along a substantially horizontal direction through the inlet 5. The possibility is not ruled out however of fitting the container 1 according to the disclosure with one or more drawers 16 which can slide along a substantially vertical direction, and which therefore can be extracted through the mouth delimited by the edge 2*a*.

In particular, the guiding means comprise at least one pair of tracks 17, which face each other and are provided inside two side walls 2*c* of the first half-shell 2, which are mutually opposite and contiguous with the previously-mentioned face, along which the inlet 5 is provided.

A respective lateral lip 16*a* of the corresponding drawer 16 can therefore be slideably guided in each track 17.

More specifically, in the preferred embodiment, the container 1 according to the disclosure comprises a plurality of drawers 16 (overlying): the guiding means comprise a plurality of tracks 17, which are mutually aligned in pairs and provided along an optionally removable internal jacket 18 lining the side walls 2*c*.

It should be noted that in FIG. 2 only a portion (half) of the jacket 18 can be seen, the portion that lines one of the two side walls 2*c* and which defines a first series of tracks 17; evidently, the other side wall 2*c* is lined by a mirror-symmetrical portion (half) of the jacket 18, which defines a corresponding number of tracks 17, aligned with the first tracks and cooperating with them to guide respective drawers 16.

It appears evident that the choice to define the tracks 17 on a removable jacket 18 further increases the versatility of the container 1 according to the disclosure, since simply by substituting the jacket 18 it is possible to vary the pitch at will, and therefore the size of the drawers 16 that can be used.

Moreover, one or more drawers 16 can be simply removed (in order to free up a corresponding interspace in which to accommodate more cumbersome objects) or substituted with others of different height, which is in any case chosen to be a multiple or submultiple of the center distance between adjacent tracks 17, so as to still be easily inserted and/or extracted.

It should be noted therefore that in the drawers 16, or in the empty interspaces, tools of any kind can be arranged, and also the element 6, the worktop 15 and/or the light source, thus defining a multitude of possible configurations, completely adaptable to the needs of the specific user.

Operation of the carryall container according to the disclosure is therefore evident from the foregoing discussion.

It has already been shown in fact that the container 1 makes it possible first of all to place inside it objects of any kind, which can be simply and freely placed in the compartment 4, or distributed in the drawers 16 and/or by using further pockets, dividers and retention elements, which to this end are provided inside the half-shells 2, 3.

The container 1 can accommodate inside it the auxiliary element 6, which the user will extract when he/she wants to interact with the container 1 proper, therefore relying on a stable support and a raised configuration.

The element 6 can in fact be easily fixed to the plate 9 integral with the base of the first half-shell 2, and is provided with a plurality of legs 8 that, in the active arrangement, extend inclined from the structure 7 and ensure the stable support.

In such condition, the user can for example work directly on the worktop 15, being able therefore to rely on a stable work surface in order to carry out his/her activities.

Such condition is of undoubted practical interest, since, as indeed noted in the foregoing pages, it defines an extreme mode of interaction with the container 1 proper: while from the inlet 5 the user can extract tools and equipment, which were previously placed in an orderly fashion in the drawers 16, on the worktop 15 he/she can carry out his/her activity, illuminated as needed by the light source.

In any place were the user needs to work, no matter how remote and lacking in the instruments that would otherwise be necessary for carrying out his/her work, the user simply needs to bring along the container 1 according to the disclosure, in order to set up a complete work station in a practical and easy manner, by being able to rely on the tools and equipment found (for example) in the drawers 16 and by working on the worktop 15.

Furthermore, the worktop 15 can be anchored directly to the element 6, defining a kind of independent table and offering an additional practical mode of use, and assistance, to the user.

As it has been seen, pockets, dividers, retention elements and/or drawers 16 ensure many and varied possibilities for the ordered partitioning of tools, equipment and objects in general.

In such context, it should be emphasized that the container 1 provides high assurances in terms of rigidity and seal (impenetrability to water, dust etc.), ensuring its transport even in hostile environments.

The modes of use of the container 1 according to the disclosure can thus be of undoubted practical interest for a plurality of applications and a corresponding plurality of professional workers.

For example, professionals, such as doctors, nurses or tattoo artists, as well as specialist technicians, soldiers on a mission etc., can carry out their work on the worktop 15 and in general by using the container 1 according to the disclosure.

Precisely, with reference to the activity of tattoo artists and nurses, or other health personnel, the container 1 is of exceptional interest, since it makes it possible to work in environments that are not equipped, of the type of dwellings of patients.

In fact, by virtue of the container 1 the tattoo artist or the nurse can rapidly set up a work station in a room of the dwelling (which is otherwise not equipped), in order to then access the compartment 4 to retrieve the necessary equipment.

Precisely in such applications (but also in others), the worktop 15 is supplied sterile, and made of a material compatible with the use for health purposes to which it is desired to apply it.

In practice it has been found that the carryall container according to the disclosure fully achieves the set aim, since the use of an auxiliary element that comprises a fixed structure for supporting a plurality of legs, which can move between a minimum space occupation arrangement and an active arrangement, makes it possible to provide a highly resistant carryall container, which offers direct support to professionals and users in general, during their work.

The disclosure, thus conceived, is susceptible of numerous modifications and variations. Moreover, all the details may be substituted by other, technically equivalent elements.

In the embodiments illustrated, individual characteristics shown in relation to specific examples may in reality be substituted with other, different characteristics, existing in other embodiments.

In practice, the materials employed, as well as the dimensions, may be any according to requirements and to the state of the art.

The disclosures in Italian Patent Application No. 102016000011396 (UB2016A000130) from which this application claims priority are incorporated herein by reference.

The invention claimed is:

1. A carryall container, comprising at least one first half-shell, which is open and configured to close, at a free edge thereof, by a second half-shell, in order to define at least one closed configuration, in which inside said half-shells at least one internal compartment is defined for accommodating objects, said second half-shell being movable between said closed configuration and at least one open configuration, for free access to said compartment, one face of said first half-shell, which is adjacent to said free edge, having at least one door arranged, in at least one first position, so as to close a respective inlet provided on said first half-shell for further access to said compartment, said door being selectively movable between said first position and at least one second position, for free access to said compartment through said inlet, further comprising an auxiliary element for stably resting on the ground, configured to be associated detachably with the base of said first half-shell, on the opposite side with respect to said free edge, said auxiliary element comprising a fixed supporting structure and a plurality of legs attached to said structure, the plurality of legs being configured to move between a minimum space occupation arrangement and, configured to be arranged so as to face and be proximate to said structure and said auxiliary element can be accommodated in said compartment, and an active arrangement, in which said legs are extended from said structure in order to define, when said auxiliary element is associated with said base, a stable resting on the ground, further comprising a plate configured to be applied externally to said base in a stable manner and to define a resting on the ground at least when said auxiliary element, in the minimum space occupation arrangement, is accommodated in said compartment, said plate being detachably associatable with said structure by way of respective selective fixing means, wherein said fixing means comprise a plurality of teeth that protrude from said plate and rotate between at least one first angular orientation, the plurality of teeth are freely insertable into respective slots provided on a contoured plate, which substantially constitutes said structure, and at least one second angular orientation, in which, as a consequence of their insertion into the respective said slots, the plurality of teeth oppose by mechanical interference the subsequent extraction of said plate, for the fixing of said auxiliary element to said plate, and to said first half-shell.

2. The container according to claim 1, wherein each one of said legs comprises a rigid rod articulated with one of its ends to said structure, for its movement between said arrangements, each one of said rods having dimensions that are compatible with its accommodation in said compartment, in said minimum space occupation arrangement.

3. The container according to claim 1, wherein said plate is provided with a plurality of centering holes, a respective complementarily shaped resting foot that protrudes from said plate being insertable into each one of said holes.

4. The container according to claim 1, further comprising a worktop configured to be transported inside said compartment and configured to be arranged along said free edge so as to close said compartment, at least when said second half-shell is arranged in said open configuration, in order to define a work surface.

5. The container according to claim 4, further comprising selective anchoring means, configured to be of the type of said selective fixing means, for the stable and detachable coupling between said worktop and said auxiliary element, at least when said legs are in said active arrangement.

6. The container according to claim 1, further comprising a light source configured to be transported inside said compartment and configured to be detachably anchored to one of said half-shells for lighting the surrounding area.

7. The container according to claim 1, further comprising means for guiding the sliding of at least one drawer configured to be accommodated completely in said compartment and configured to be extracted at least partially from it at at least one between said open configuration of said second half-shell and said second position of said door.

8. The container according to claim 7, wherein said means for guiding comprise at least one pair of tracks, which face each other and are provided inside two side walls of said first half-shell, which are mutually opposite and contiguous with said face, a respective lateral lip of the corresponding said at least one drawer being slideably guided in each one of said tracks.

9. The container according to claim 7, further comprising a plurality of said drawers, said means for guiding comprising a plurality of said tracks, which are mutually aligned in pairs and are provided along a removable internal jacket lining said side walls.

* * * * *